United States Patent [19]

Moelbert

[11] 4,343,209

[45] Aug. 10, 1982

[54] ZONE HEATING AND SHEARING SYSTEM, AND METHOD

[75] Inventor: Heinrich Moelbert, Bratenahl, Ohio

[73] Assignee: Advanced Machine Design Company, Cleveland, Ohio

[21] Appl. No.: 177,381

[22] Filed: Aug. 12, 1980

[51] Int. Cl.[3] ..... B26D 7/10

[52] U.S. Cl. ..... 83/16; 83/170; 83/208; 83/364; 72/342

[58] Field of Search ..... 83/15, 16, 170, 171, 83/208, 279, 361, 364; 10/27 H; 72/342, 364; 264/406; 425/384, 388, 387.1, 392, 396

[56] References Cited

U.S. PATENT DOCUMENTS

| | | | |
|---|---|---|---|
| 2,461,323 | 2/1949 | Hille | 72/342 X |
| 2,630,519 | 3/1953 | Gard | 83/16 |
| 3,256,564 | 6/1966 | Welshon | 425/384 X |
| 3,259,004 | 7/1966 | Chisholm | 83/171 |
| 3,422,711 | 1/1969 | Toney et al. | 83/15 |
| 3,488,802 | 1/1970 | Passarelli | 425/346 X |
| 3,908,496 | 9/1975 | Moelbert | 83/157 |
| 3,972,211 | 8/1976 | Linthicum et al. | 83/364 X |

FOREIGN PATENT DOCUMENTS

| | | | |
|---|---|---|---|
| 1407232 | 9/1975 | United Kingdom | 83/170 |

*Primary Examiner*—Frank T. Yost
*Assistant Examiner*—Robert P. Olszewski
*Attorney, Agent, or Firm*—Maky, Renner, Otto & Boisselle

[57] ABSTRACT

A system and method for shearing pieces from bars, characterized by the normal positioning of a bar zone heating element such as an induction heating coil at one or a multiple of piece lengths in front of the bar shear. A bar feed incrementally longitudinally advances a bar one piece length at timed intervals through the heating coil to the bar shear, whereby localized areas or zones of the bar are heated at one piece length intervals. The heat received from the heating coil at each zone soaks into the bar to raise its core temperature as each zone is advanced from the heating coil toward the bar shear. After each incremental advance of the bar, a piece is sheared from the end of the bar at the then presented heated zone. Continuous automatic operation of the system is obtained by automatically detecting the remnant end of the bar, butting the leading end of a new bar to such remnant end of the old bar, automatically advancing the old and new bars together in the aforedescribed manner, and automatically moving the heating coil toward or away from the bar shear a distance corresponding to the length of the remnant piece of the old bar after the last zone of the old bar has been heated, whereby the zones of the new bar heated by the heating coil will be spaced at one piece length increments from the leading end of the new bar. The heating coil is automatically returned to its normal position when the remnant piece of the old bar is discharged from the bar shear so that the new bar is always heated at the desired incremental bar lengths.

35 Claims, 12 Drawing Figures

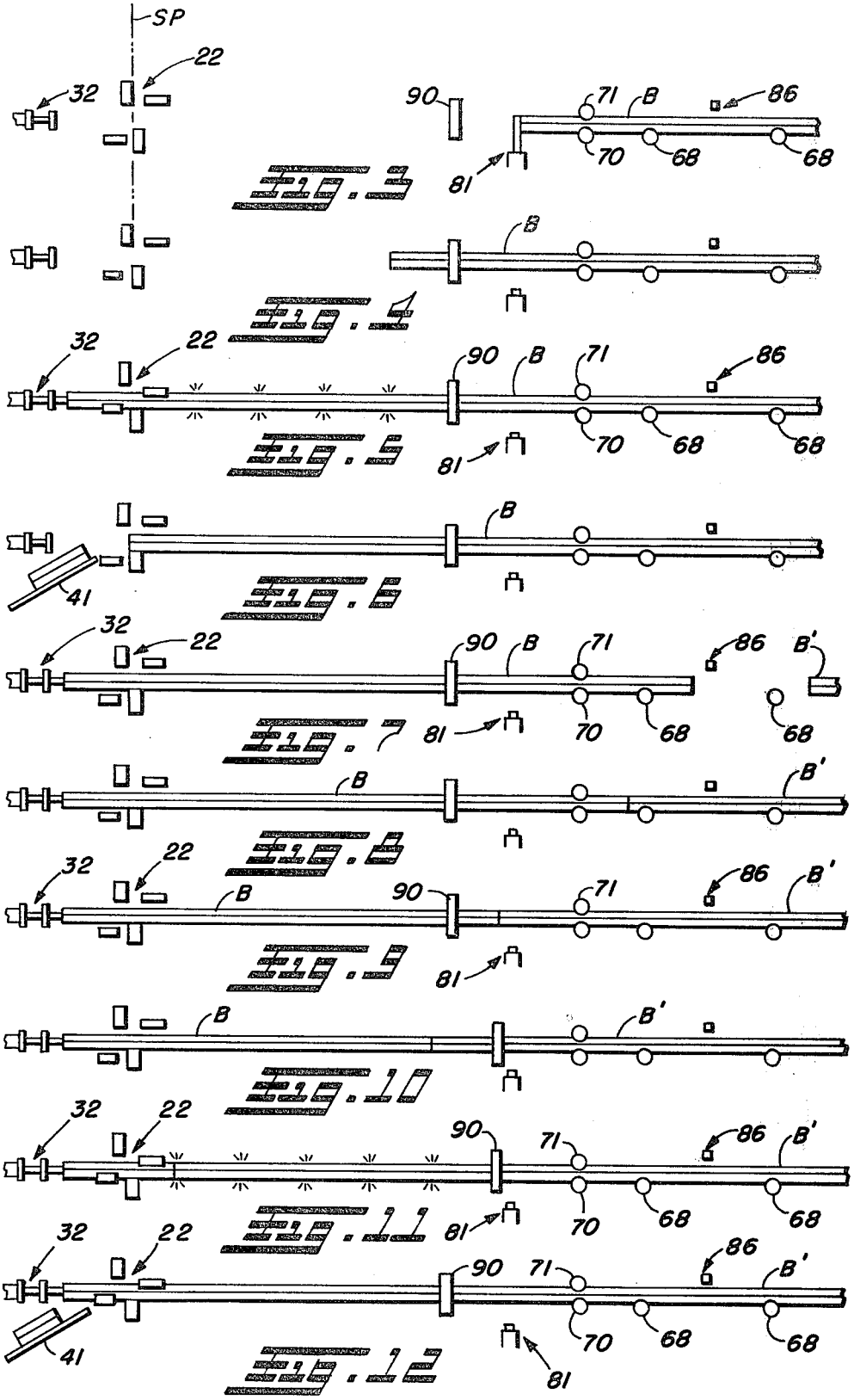
SP
22
32
90
71
B
86
70
68
68
81
B
32
22
90
B
71
86
70
68
68
81
B
41
32
22
90
B
71
86
B'
70
68
68
81
B
B'
32
22
B
90
71
86
B'
81
B
B'
32
22
90
71
86
B'
70
68
68
81
32
22
90
71
86
B'
41
70
68
68
81

ZONE HEATING AND SHEARING SYSTEM, AND METHOD

This invention relates to a shearing system and method, and more particularly to a zone heating and shearing system, and method, characterized by the normal positioning of a bar zone heating element such as an induction heating coil at one or a multiple of piece lengths in front of a bar shear. This invention further relates to a zone heating and shearing system that is readily capable of fully automatic operation.

BACKGROUND

In applicant's U.S. Pat. No. 3,908,496, entitled "Hydraulic Shearing Machine", granted Sept. 30, 1975, a shearing machine is disclosed wherein the bar being sheared is engaged on both sides of the shear plane by a balanced back support and hold-down clamping system. The balanced clamping system minimizes distortion and bending of the bar during shear. Such shearing machine is capable of shearing with desirable results many metals including many alloys theretofore considered unshearable. Even so, there are other metals that heretofore could not be sheared effectively by such a shearing machine due to the formation of stress cracks and the like, nor, to applicant's knowledge, could they be sheared effectively by any other commercially available shearing machine. These metals include, for example, high temperature alloys used in the aircraft industry, titanium, 52100 steel in an as-rolled condition, and other metals. Accordingly, other methods had to be employed for cutting them. One known method is to use hack saws or band saws to cut the metal bars into pieces while other methods involve the use of milling cutters, abrasive cutters or torch cutters to cut the bars. These methods, however, are all very costly and slow.

For some high alloy steels such as 4340 steel, it is also known to heat the metal bar to a high temperature and then to shear it while it is still hot to eliminate cracking. Typically, the entire bar is heated in a gas furnace to a relatively high temperature depending on the alloy. For example, a 4340 steel bar might be heated to 900° to 1000° F. This heating of the bar, however, is costly and time consuming. For instance, it typically takes several minutes and substantial amounts of energy to heat a bar of say 5-inch bar size to such high temperature.

It is also known to heat the metal bar by employing resistance heating or induction heating techniques. Here again, the heating of the bar is extremely costly. Moreover, a tremendously large power unit is needed to heat the larger diameter bars to the required temperatures at which they can be sheared.

A single induction heating coil has previously been used to heat small diameter bars of uranium to a relatively high temperature such as 600° in a relatively small area or zone where the bar is to be sheared. When the bar reaches the required temperature as determined by an optical pyrometer, it is immediately fed into the shear and sheared. While the optical pyrometer might be used effectively in a controlled environment, a forge shop is normally not a good environment for the optical pyrometer. In the forge shop, the pyrometer is likely to get dirty, or be knocked or vibrated out of adjustment or knocked off or damaged in some way. Also, the optical pyrometer only measures surface temperature of the bar, which will be reached much sooner than the desired core temperature for producing the desired quality of cut by hot shearing, particularly when larger diameter bar stock is being sheared.

OBJECTS OF THE INVENTION

With the foregoing in mind, it is a principal object of this invention to provide a zone heating and shearing system, and method, that can shear with desirable results many metals including those heretofore considered unshearable or difficult to shear.

Another object of this invention is to provide a zone heating and shearing system, and method, which can provide high quality shearing at low cost and high rates of production.

Still another object of this invention is to provide a zone heating and shearing system, and method, having low energy requirements.

Yet another object of this invention is to provide a zone heating and shearing system, and method, which are suited for use in forge shop environments and the like.

A further object is to provide a zone heating and shearing system that is readily capable of automatic operation.

Other objects and advantages of this invention will become apparent from the following summary and detailed description.

SUMMARY OF THE INVENTION

In contradistinction to known shearing systems and methods, the system and method according to this invention, for shearing predetermined lengths of bar pieces, billets or the like from bar stock, are characterized by the positioning of a bar zone heating element such as an induction heating coil at a single or multiple of piece lengths in front of a bar shear. The bar being sheared is incrementally longitudinally advanced one piece length at specified intervals through the heating coil to the shear. The bar is sequentially heated by the heating coil at localized areas or zones along its length at intervals of one piece length. The heat received from the heating coil at the zones soaks into the bar as the zones are incrementally advanced from the heating coil until sequentially presented to the bar shear. After each incremental advance of the bar, a piece is sheared from the end of the bar at the then presented heated zone.

More particularly, a zone heating and shearing system according to this invention includes a bar shear for shearing pieces, billets or the like from the end of the bar, and a zone heating element for heating the bar at a localized area or zone, such heating element being located at a single or multiple of piece lengths in front of the bar shear. The bar is incrementally longitudinally advanced or indexed one piece length at specified intervals past the heating element to the bar shear, thereby sequentially to align heated zones of the bar with the bar shear for shearing a piece from the bar at each such heated zones.

The amount of heat introduced into the bar by the heating element at each bar zone is preferably time determined. Moreover, the heating element is spaced one or several piece lengths in front of the bar shear, whereby as each heated bar zone travels from the heating element to the bar shear, the heat soaks into the bar to increase its core temperature to provide advantageous conditions for shearing. High rates of production can nonetheless be achieved while still providing adequate soak time because the bar is zone heated at one or some multiple of piece lengths in front of the shear as it is regularly indexed to the shear. The production rate essentially is limited only by the cycle speed of the shear or the time required to heat each bar zone. In addition, energy requirements are low because only a localized area or zone of the bar is heated.

The zone heating and shearing system is capable of continuous automatic operation, and to this end further includes a bar end detector which detects the passage of the trailing end of the bar before it reaches the heating element. When the bar trailing end is detected, a bar loader automatically delivers a new bar to the bar feed whereupon the new bar is brought into butted end relationship with the old bar. The old and new bars are then advanced together in the aforedescribed incremental manner by the bar feed.

The automatic system further includes a bar travel measuring device and a movable carriage for the heating element. The measuring device may be used to control each incremental advance of the bar, and operates in conjunction with the bar end detector to determine when the remnant piece of the old bar and the leading end of the new bar passes the heating element. Upon such passage, the movable carriage for the heating element automatically moves the heating element away from or towards the bar shear a distance equal the length of the remnant. In this manner, the zones on the new bar heated by the heating element as it is incrementally advanced thereby, will be spaced at one piece length increments from the leading end of such new bar. When the remnant is finally ejected from the bar shear, the carriage returns the heating element to its normal location for continued heating of the new bar at the desired zones each spaced one piece length apart.

While different types of bar shears may be incorporated in such system, improved results may be obtained using a bar shear including a balanced back support and hold-down clamping system of the type disclosed in U.S. Pat. No. 3,908,496, particularly when it is desirable or necessary to substantially eliminate bending of the bar and high pressure rubbing or scoring contact of the sheared surfaces during shearing in order to obtain the desired quality of cut.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF THE DRAWINGS

In the annexed drawings:

FIGS. 3–12 are schematic diagrams illustrating a preferred operational sequence of such system.

DETAILED DESCRIPTION

Figure 1:
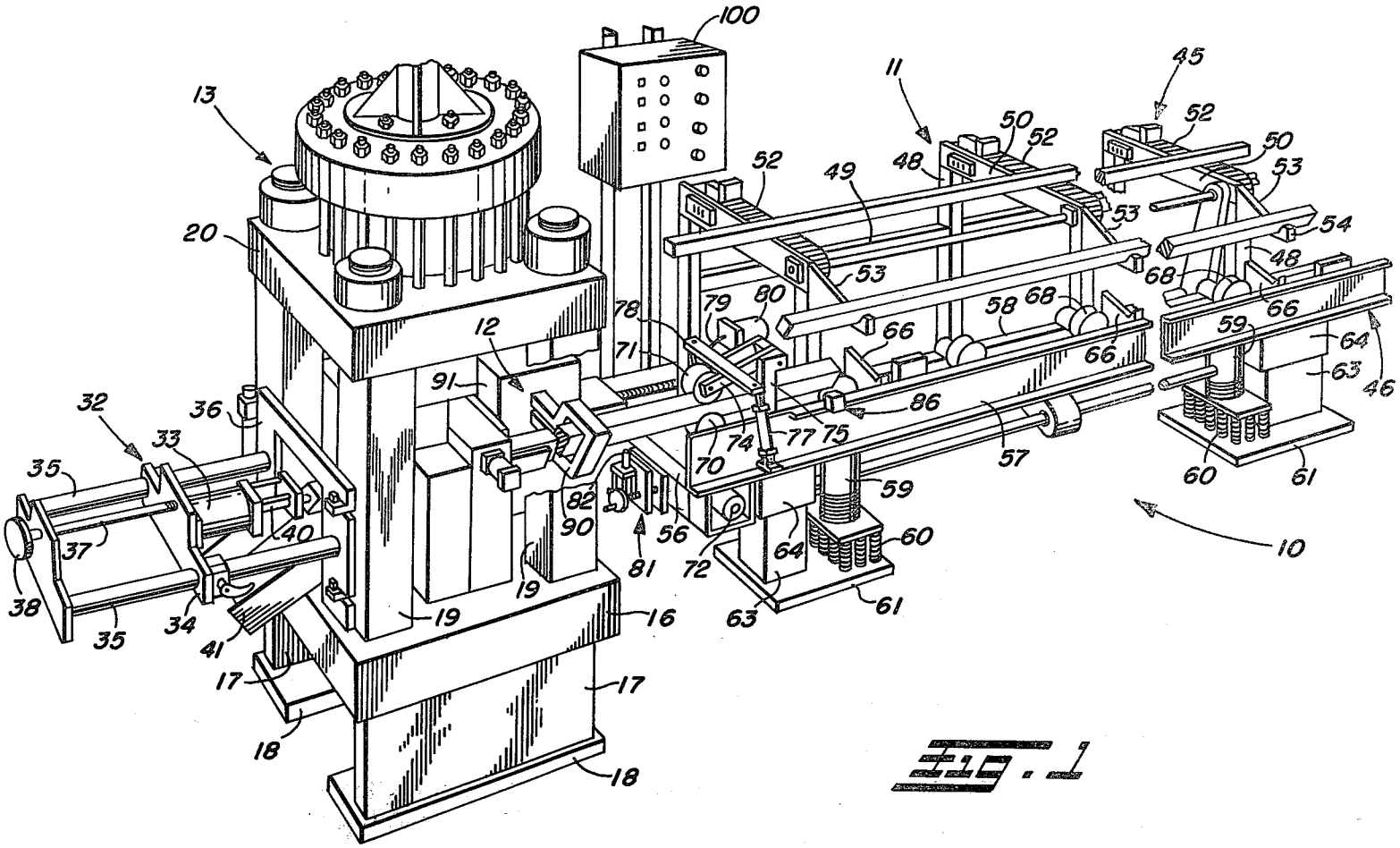
FIG. 1 is a fragmented perspective view, partly broken away, of a preferred embodiment of a zone heating and shearing system according to the present invention.

Referring now in detail to the drawings and initially to FIG. 1, a preferred embodiment of zone heating and shearing system in accordance with this invention is generally designated by reference numeral 10. From right to left, the zone heating and shearing system generally comprises a zone heater assembly 12 and a shearing assembly 13. As seen, a bar storage and feed assembly 11 is desirably provided for storage and feeding of the bar stock to the zone heater assembly 12 and shear assembly 13 which are positioned in in-line relationship. Since the positions of the storage and feed assembly and heater assembly are referenced to the position of the shearing machine, the shearing machine first will be described.

THE SHEARING ASSEMBLY 13

Preferably the shearing assembly 13 seen in FIG. 1 is of the type disclosed in applicant's U.S. Pat. No. 3,908,496, entitled "Hydraulic Shearing Machine", dated Sept. 30, 1975, which patent is hereby fully incorporated herein by reference. Although reference may be had to such patent for a more complete description of the shearing assembly 13, its construction and operation will be briefly described.

In FIG. 1, it will be seen that the hydraulic shearing assembly 13 includes a horizontal base plate 16 which is supported above the floor by vertical support plates 17 mounted on footers 18. Extending vertically upwardly from the base plate 16 are four tie bars 19 which support at their upper ends a horizontal head plate 20. The head plate 20 and base plate 16 are the main structural components of the shearing assembly on which are mounted the tool assembly of the shearing machine and the hydraulic actuators therefor.

Figure 2:
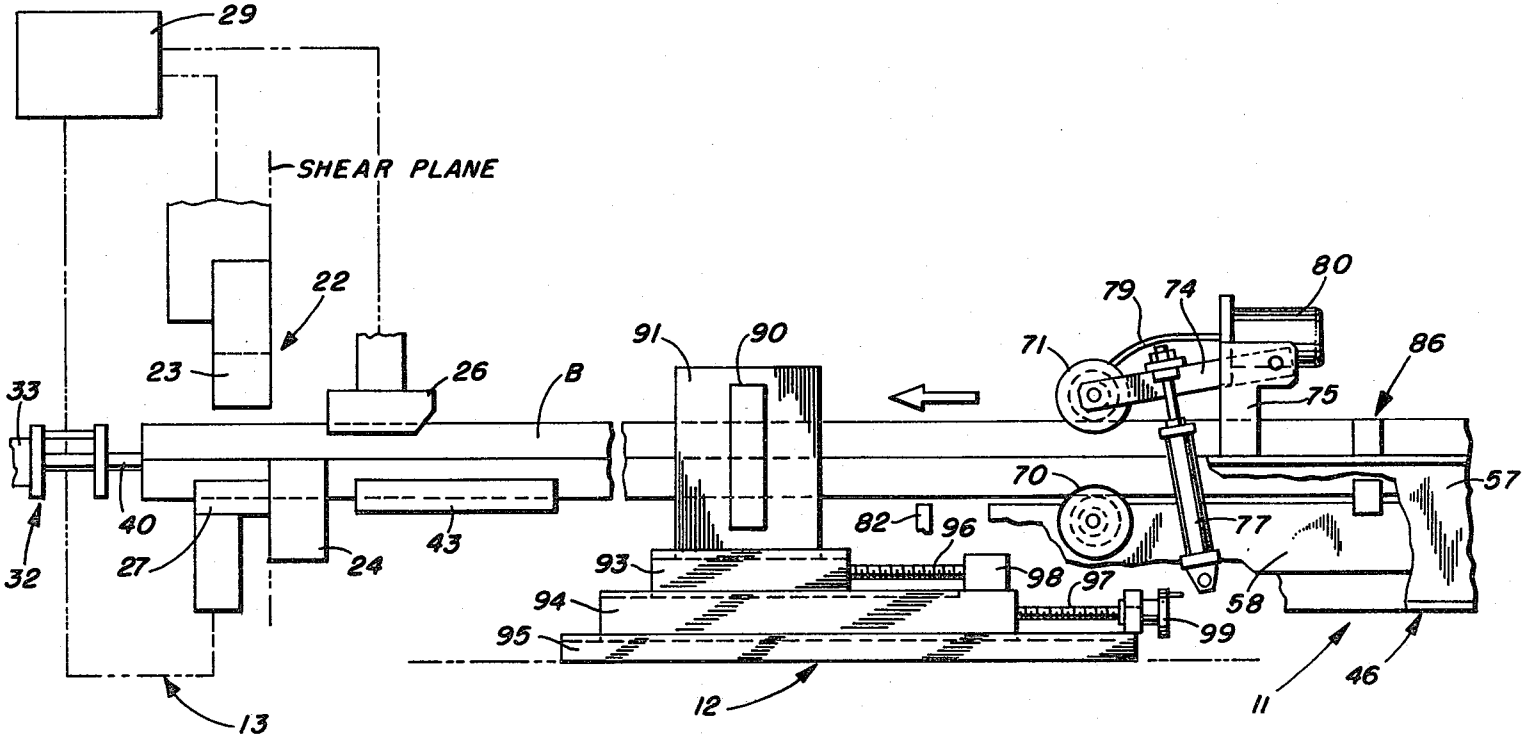
FIG. 2 is a fragmented, schematic side elevation of the system of FIG. 1.

Referring now to FIG. 2, the tool assembly is seen at 22 and includes a movable knife 23 and a fixed knife 24. The movable knife and fixed knife cooperate to shear the bar B along the shear plane which is identified as such in FIG. 2. The tool assembly 22 further includes a bar hold-down 26 and a bar back support 27. The hold-down is movable downwardly into engagement with the upper side of the bar B to hold the bar against the fixed knife during shear. The back support 27, on the other hand, is movable upwardly into engagement with the underside of the bar opposite the movable knife 23. During the shear cycle, the back support 27 yields to the movable knife while holding the bar thereagainst.

The movable knife 23, hold-down 26 and back support 27 are preferably operated by respective hydraulic actuators which are all connected and operated by a hydraulic system collectively designated by reference numeral 29 in FIG. 2. The hydraulic system 29 desirably controls the actuation of the hold-down and back support so that the force applied thereby to the bar is proportional to the shear force being applied by the movable knife 23. When the shearing force decreases, the forces applied by the hold-down and back support to the bar correspondingly decrease. By reason of this cooperation between the movable knife, hold-down and back support, high pressure rubbing or scoring of the bar surfaces engaged thereby is eliminated because of the lack of high pressure which permits the cut bar piece to slip longitudinally as it is being displaced vertically by the movable knife and back support. The hold-down 26 resists bar kick-up without applying a massive clamping force on the bar while the back support 27 resists downward bending of the piece being sheared. The shearing assembly thereby clamps the bar on both sides of the shear plane using a balanced clamping system to minimize the amount of distortion or bending of the bar during shearing.

Still referring to FIG. 2 and again to FIG. 1, the shearing machine 13 at its rear end can be seen further to include an adjustable back gage 32. The back gage 32 shown includes a piston-cylinder assembly 33 which has its cylinder end mounted on an adjustable frame member 34. The adjustable frame member is guided for movement toward and away from the shear plane on guide rods 35 which extend horizontally from mounting plate 36. The mounting plate 36 is secured to the tie rods 19. A lead screw 37 and a hand crank 38 therefor may be provided for adjusting the position of the frame member 34.

The rod 40 of the piston-cylinder assembly 33 is in substantial coaxial alignment with the path of the bar through the shearing assembly 13. With the back gage 32 properly adjusted, and the rod extended, the rod will be engaged by the end of the bar to position it with respect to the shear plane as seen in FIG. 2. The back gage of course will be adjusted to position the end of the bar one piece or billet length from the shear plane. After the shear cycle, the rod may be momentarily retracted a sufficient length of time to permit the sheared piece or billet to be pushed out of the tool assembly and fall freely into a discharge chute 41 during indexing of the bar thereby readying the shearing assembly for the next shearing cycle. A bar support 43 schematically shown in FIG. 2 may be provided adjacent the front end of the shearing assembly as added support for the bar as it is longitudinally advanced to the shearing assembly by the bar storage and feed assembly 11.

THE BAR STORAGE AND FEED ASSEMBLY 11

The bar storage and feed assembly 11 as seen in FIG. 1 may generally be of conventional construction and includes an elevated storage table or other device 45 and feed table 46. The storage table 45 includes vertical frame members 48, horizontal stabilizer ties 49, and horizontal top frame members 50 which are assembled in the form of a box-like skeleton frame and which may be supported on the floor or other suitable support structure. The top frame members 50 extend next to the feed table 46 and together define the top surface of the elevated storage table on which a number of bars can be stored.

Secured to each top frame member 50 is a drag chain assembly 52 of known construction. The drag chain assemblies 52 also extend perpendicularly to the feed table 46 and are commonly driven to move the bars supported on the top frame members laterally towards inclined loader arms 53. The loader arms are secured to the vertical frame members 48 and project over the feed table, and are provided with integral stops 54 at their distal ends. When the bars supported on the storage table 45 are laterally advanced toward the loader arms, the leading bar will be moved onto the loader arms whereupon it will slide down the arms into engagement with the integral stops. From this position, the bar can be loaded onto the feed table 46.

The feed table 46 shown has a horizontal elongated bottom plate 56 and elongated vertical side plates 57, 58 extending upwardly from the sides of the bottom plate. The feed table may be supported at its ends on table leveler assemblies 59 which enable the table to be leveled, and also provide for height adjustment of the feed table so that the bar supported thereon particularly when bent can be aligned properly with the shearing assembly 13. The leveler assemblies 59 in turn may be supported on shock absorber assemblies 60 mounted on footers 61. The shock absorber assemblies absorb any shock resulting from the bar being loaded onto the feed table.

The footers 61, which preferably are fixedly secured to the floor or other suitable support structure, also each have secured thereto a vertical box-like projection 63 which closely and slidingly fits into a tubular socket 64 depending from the ends of the feed table 46 to prevent lateral sway of the feed table while permitting vertical adjustment and shock absorbing movement thereof.

To load the bar held by the loader arms 53 onto the feed table 46, the feed table is provided with three longitudinally spaced elevator plates 66 having a V-shape top surface. As is known, the elevator plates 66 can be pivotally mounted on the feed table and driven so that they can pivot or extend upwardly into engagement with the bar held by the loader arms 53. Further rotation or extension of the elevator plates lifts the bar from the loader arms over the integral stops 54 whereupon the bar will slide downwardly along the top surface of the plates into the bight of the V. The elevator plates then reversely pivot or retract to deposit the bar supported thereby onto the feed table rollers 68.

The feed table rollers 68 may be V-notched as shown and are mounted in alignment on shafts which are journaled between the side plates 57 and 58 of the feed table 46. One or more of the rollers 68 is rotatably driven by a suitable drive so that a bar supported on the rollers can be advanced longitudinally from its initial load position towards the shearing assembly 13 and between index roller 70 and measuring roller such as pinch roller 71 located at the end of the feed table closest to the shearing assembly.

The index roller 70 is mounted on the feed table 46 similarly to the table rollers 68 and in alignment therewith, but is independently rotatably driven by a feed motor seen at 72 in FIG. 1. In this manner, the index roller can controllingly and incrementally advance the bar desired distances while a new bar is being loaded onto the table and advanced by the table rollers 68 to bring its leading end into abutment with the end of the old bar.

The pinch roller 71 is mounted above the index roller 70 on an arm 74 at one end thereof. The other end of the arm 74 is pivoted between vertical parallel brackets 75 secured to the table side plates 57, 58. The pinch roller is raised and lowered into and out of positive engagement with the bar by a piston-cylinder assembly 77 positioned at one side of the frame. The rod end of the assembly is connected to one end of a yoke 78 secured to the arm 74 while the cylinder end is secured to one of the side plates 57, 58 of the feed table.

For a reason that will become more apparent from the following description, the pinch roller 71 is connected as by a cable 79 to a transducer, servomechanism, or other signal device 80 which generates an output in response to rotation of the pinch roller. The transducer for example may control a counter or other signal storage device which counts the number of revolutions or fractions thereof as the pinch roller is rotated by the bar moving longitudinally thereunder. Accordingly, the pinch roller and transducer serve as a bar travel measuring device. In this manner, the position of the leading end of the bar can be determined if desired at all times during advancement of the bar, once the leading end of the bar has been precisely located at a reference point, and such mechanism can also be used to control the incremental advancement of the bar one piece length at a time without having to use the back gage 32.

As best seen in FIG. 1, an initial reference point for the bar may be identified by a bar stop 81. The bar stop includes a piston-cylinder assembly 82 which is adjustably mounted at the end of the feed table 46 nearest the shearing assembly 13 for adjustment towards and away from the shearing assembly. The rod of the assembly 82 extends upwardly and when actuated, will extend into the path of the bar so that the bar can be butted thereagainst. The stop preferably is adjusted so that the end of the bar when in engagement therewith will be spaced one piece length in front of the induction heating coil of the zone heater assembly described hereinafter.

Alternatively, the upper shear 23 when in its lowered position can be used to locate the end of the bar one or a multiple of piece lengths in front of the induction heating coil.

The feed table 46 is also provided with a bar end detector which, as best seen in FIG. 2, may be a measuring device such as an electric eye 86, the transmitter portion and receiver portion of which are mounted on the side plates 57, 58 of the feed table, respectively. Upon movement of the remnant end of the bar past the electric eye, the circuit will be completed thereby instantaneously identifying the location of the bar end. If the position of the sensor with respect to the shear plane is known, the number of remaining pieces to be cut and the length of the remnant piece can be determined. The position of the electric eye may also be referenced to the position of the induction heating coil of the heater assembly for a reason that will become fully apparent from the following description.

The Zone Heater Assembly 12

Still referring to FIGS. 1 and 2, it will be seen that the zone heating device 90 of the zone heater assembly 12 is located between the shear assembly 13 and storage and feed assembly 11 with its axis coinciding with that of the bar being fed by the latter to the former. Preferably, the zone heating device consists of an induction heating element or coil 90 which in known manner is connected and supported by a junction box 91 which may house, for instance, the water cooled transformer for the heating coil. However, it will be appreciated that other energy sources including gas, oil or other heat sources can be used to heat the bar at localized areas thereof in the manner described hereafter if desired. The heating coil 90 is shown plugged into the box so that it may be easily replaced by other heating coils for different sizes and profiles of bars. The junction box may also have a second socket therein so that the two coils can be used for heating a wider region or another region of the bar one or a multiple of piece lengths therefrom if desired. If, for example, the shear cycle is twice as fast as the time required to heat the bar at the desired regions, the bar could be heated in stages at such regions by two or more coils spaced one or more multiple of piece lengths apart.

As best seen in FIG. 2, the junction box 91 is mounted on a carriage 93 which in turn may be mounted on another carriage 94 for relative movement of the first carriage 93 toward and away from the shearing assembly 13. The carriage 94 is also mounted for movement toward and away from the shearing assembly 13 on a carriage support member 95. The support member 95 may conveniently be secured to the storage and feed assembly 11 or supported by its own frame on the floor.

A rotatable lead screw or other device 96 is provided to adjust the position of the carriage 93 with respect to the carriage 94 while lead screw 97 adjusts the position of the carriage 94 with respect to the carriage support member 95. The lead screw 96 for the carriage 93 is rotatably driven by a motor 98 or other device for automatic operation thereof. Automatic adjustment of the carriage 94 is not needed and accordingly, the lead screw 97 may be manually operable by hand crank 99.

It can now be appreciated that the carriage 93 and carriage 94 permit primary and secondary positional adjustments of the junction box 91, and hence the heating oil 90, with respect to the shearing assembly 13. With the carriage 93 adjusted to a nominal or reference position, the carriage 94 can be adjusted to locate the coil a multiple of bar piece or billet lengths from the shear plane of the shearing assembly. As discussed hereinafter, the bar may be incrementally advanced one piece length at timed intervals sequentially to position heated zones of the bar at the shear plane of the shearing assembly. By positioning the heating coil one or a multiple of piece lengths from the shear plane, the heat that is applied at each heated region or zone will soak into the bar so that by the time the heated section reaches the shear plane, the core temperature of the bar will be sufficiently high to provide high quality shearing. The number of piece lengths that the coil is positioned in front of the shear plane will depend upon the desired amount of soak time and the amount of time it takes to heat the bar at each zone and incrementally advance it for any given bar size.

While two such carriages 93 and 94 are desirably provided for obtaining such primary and secondary adjustments of the heating coil, it should be appreciated that a single carriage could be utilized for making both such adjustments if desired.

From the foregoing, it will be apparent that the cycle time for the system can be optimized for any given bar size. The shear cycle time or heating cycle time essentially will determine the cycle time of the system. For example, the shear time might be 4 to 5 seconds. If the heating time based on a given coil power output takes longer than that, then the heating cycle will control movement of the bar unless additional power output is available to heat the bar. If the heating cycle is faster than the shearing cycle, then the power output must either be adjusted to coincide with the shear cycle, or the induction coil must be turned off after the bar has been heated to a predetermined temperature to let the bar soak before it is advanced. Accordingly, the system can be adjusted between heating time, soak time and shear cycle time for optimum shear and production rate.

Operation

Before describing a preferred operational sequence of the zone heating and shearing system of the subject invention, it should be understood that the invention contemplates the use of an electric control circuit or the like for effecting automatic operation or semi-automatic operation of the system. The control circuit preferably would also provide for manual operation of the system as well and may be contained in a control unit such as that seen at 100 in FIG. 1. The particular control circuit is not part of this invention and therefore is not disclosed; however, it will be apparent to those skilled in the art that a suitable control circuit can be readily devised using known control circuitry to operate the system in accordance with the below described operational sequence. Such control circuit, for example, may include a programmable microprocessor using known digital techniques.

The control circuit of course would be connected to the system components for controlling their operation in accordance with the below described operational sequence and would also be connected to the pinch roller transducer 80 and bar end detector 86 for input as to the bar's position with respect to the other system components. It will be seen below that fully automatic operation of the system can be achieved utilizing such inputs.

Referring now to FIGS. 3–12, a preferred operational sequence is shown. With respect to the Figures collectively, the shear plane is identified by the letters SP.

In FIG. 3, a first bar B is shown already loaded onto the feed table 46 and supported by the table rollers 68. The first bar has also been advanced longitudinally into abutment with the raised bar stop 81, which has been previously adjusted to locate the leading end of the bar one piece or billet length in front of the transaxial center plane of the heating coil 90. Alternatively, the bar could be moved into engagement with the lowered knife 23 to locate the bar one or more piece lengths in front of the heating coil. The pinch roller 71 has also been lowered into engagement with the top side of the first bar opposite the index roller 70.

It should also be noted that the positions of the heating coil 90 and back gage 32 have by now been adjusted for the particular length of the bar pieces, billets or the like to be sheared. As previously noted, the back gage 32 is adjusted so that when extended, the end of the first bar butted thereagainst is located one piece length beyond the shear plane SP of the tool assembly 22 of the shearing assembly 13. The coil 90 is adjusted by moving the adjustment table longitudinally to a location a single or multiple of piece lengths in front of the shear plane, the number of piece lengths being determined in the manner previously indicated. In FIG. 3 the coil is shown located for example five piece lengths in front of the shear plane of the tool assembly 22.

Automatic operation of the zone heating and shearing system may now be initiated such as by actuating a system start switch in the control circuit. Upon initiation of such automatic operation, the control circuit will cause the bar stop 81 to retract and the first bar will be advanced to piece lengths towards the shear plane by the index roller 70. At the same time, the heating coil 90 is energized and preferably will remain continuously energized during system operation. Alternatively, the heating coil could be operated by a timer, but that could slow down the cycle time due to equipment start-up time after each cycle.

When the first bar advancement has stopped in the position seen in FIG. 4 with the leading end of the bar located one piece length beyond the heating coil 90, the control circuit will either activate a timer circuit or timer therein for determining the heating time for the bar region or zone then circumscribed by the heating coil, or the shear cycle may control such heating time depending on which takes longer.

If a timer is used to control the heating time, when the timer times out, the control circuit will cause the index roller 70 again to advance the first bar. However, this time the first bar will advance only one piece or billet length. Accordingly, the next region or zone of the first bar circumscribed by the heating coil 90 will be located two piece or billet lengths from the leading end of the first bar and one piece length from the first heated bar zone. The timer is again activated to determine the heating time for the second zone of the first bar. When the timer times out again, the first bar is advanced another piece length and the timer reset. This continues until the leading end of the first bar reaches the position seen in FIG. 5 engaging the back gage 32.

In this position the leading end of the first bar is located one piece length from the shear plane SP with the first heated zone of the first bar positioned at the shear plane. The control circuit can now actuate the tool assembly 22 to shear the first piece or billet from the first bar. When the shearing operation is complete, if a back gage is used to locate the end of the bar, the back gage is momentarily retracted to permit the piece to drop into the chute 41 provided therefor as seen in FIG. 6 and be ejected from the shearing assembly 13 during the next indexing movement of the bar.

It should be understood that by the time the first heated zone reaches the shear plane SP it will have had sufficient time for the heat to soak into the bar. Such soak time is equal to the time required incrementally to advance and heat each subsequent zone until the leading end of the first bar engages the back gage 32. In the sequence illustrated, this would be equivalent to four heating periods plus the time required to incrementally advance the bar five times.

After the first piece is sheared by the shearing assembly 13 and the bar zone then at the heating coil has been heated the required length of time, the control circuit causes the index roller 70 to advance the first bar another piece length, during which the back gage is first retracted to permit removal of the sheared piece and then extended for locating the new end of first bar with respect to the shear plane. The tool assembly 22 of the shearing machine 13 is then actuated to shear the next piece from the first bar. The first bar will continue to be incrementally advanced in this manner at timed intervals and sheared after each advancement, until the bar end detector 86 detects the remnant end of the first bar.

In FIG. 7 the trailing end of the first bar is shown having already passed the detector 86 during the last incremental advance thereof. With the position of the detector with respect to the shear plane being known, the number of pieces remaining to be cut from the bar and the remnant piece length can be determined by the control circuit. The remnant piece length preferably is at least one-half the bar diameter or section so that the tool assembly 22 can grip the piece properly for shearing. In addition to determining the remnant piece length, the control circuit can also determine from the output of the transducer 80 connected to pinch roller 71 when the remnant end of the first bar reaches the heating coil 90.

When the remnant end of the first bar is detected by the detector 86, the control circuit may also be used to cause a second bar B′ to be loaded onto the feed table 46 and advanced towards the first bar to bring its leading end into abutment with the remnant end of the first bar. The second bar should be butted with the first bar prior to the remnant end of the first bar reaching the index roller 70 and pinch roller 71 as seen in FIG. 8, so that the pinch roller can continue to monitor the position of the first bar as it is pushed by the second bar then being advanced by index roller 70.

In FIG. 9, the first and second bars B, B′ are shown having advanced together to a position where the last zone of the first bar yet to be heated is at the heating coil 90 and only the remnant end of the first bar remains.

After the last one of the first bar has been heated for the required time, the control circuit will cause heating coil 90 to move longitudinally toward or away from its normal position and from the shearing assembly 13 the length of the remnant piece. At the same time, the bars are advanced one piece length.

As seen in FIG. 10, the heating coil 90 now circumscribes the second bar B′ at a zone located one piece length from the leading end of the second bar. The first zone of the second bar also is located one or the same multiple of piece lengths plus the remnant length from the shearing plane SP.

From this point on, the system will continue to incrementally advance both bars B, B′ one piece length at timed intervals and shear each successive piece from the first bar until the last piece of the first bar is sheared from the remnant piece. The remnant piece usually will be less than one piece length and accordingly, the next incremental advance of the second bar will eject the remnant piece from the tool assembly 22 of the shearing assembly 13 as seen in FIG. 12. The control circuit will continue to advance the second bar until its leading end engages and is positioned by the back gage 32 as seen in FIG. 12. The first heated zone of the second bar will then be aligned with the shear plane whereupon the first piece of the second bar can be sheared therefrom. Also at that time the control circuit will cause the heating coil 90 to be returned to its original or normal position as further shown in FIG. 12. Accordingly, the next zone heated on the second bar will be spaced one piece or billet length from the preceding heated zone. The system can now continue to shear pieces or billets from the second bar and each bar thereafter in the same manner described above and illustrated in FIGS. 6–12.

An example of the type of materials that can be satisfactorily sheared using the system and method of the present invention is 4-inch diameter bars of 52100 steel as rolled. Under normal circumstances it is impossible to cold shear such material in these bar sizes without substantial cracking or shattering, but not with the system of the present invention. During actual tests that were successfully conducted in the shearing of such material, the induction heating coil was located three piece lengths in front of the shear, and the bar was heated at each localized area thereof for 11 seconds during which the surface temperature of the bar was heated to approximately 1450° F. Since in this particular case the energy output of the induction coil was such that the required heating time was longer than the shear cycle time, the heating time was used to determine the multiple of piece lengths of the heating coil in front of the shear, in this case three piece lengths, to obtain the desired soak time of approximately 33 seconds before the bar was sheared at each heated zone.

Although the invention has been shown and described with respect to a preferred embodiment, it is obvious that equivalent alterations and modifications will occur to others skilled in the art upon the reading and understanding of the specification. The present invention includes all such equivalent alterations and modifications, and is limited only by the scope of the claims.

The embodiments of the invention in which an exclusive property or privilege is claimed are defined as follows:

1. A zone heating and shearing system for shearing pieces of predetermined length from a bar, comprising: shearing means for sequentially shearing the pieces from the end of the bar along a shear plane, zone heating means for heating the bar at a localized shear area thereof, feed means for incrementally longitudinally advancing the bar one piece length at specified intervals past said zone heating means to said shearing means, and means for locating said zone heating means at a number of piece lengths in front of such shear plane corresponding to the soak time required to obtain the desired core temperature of such bar at each of such localized shear areas by the time each such localized shear area is incrementally advanced from said zone heating means through a region free from heating to said shearing means and shearing takes place.

2. The system of claim 1, wherein said feed means incrementally advances the bar one piece length at timed intervals which are at least as long as the length of time required to shear the bar during each shear cycle.

3. The system of claim 1, wherein said feed means is responsive to the completion of each shear cycle to incrementally advance the bar one piece length.

4. The system of claim 1, wherein said zone heating means includes means for heating the bar at such localized areas thereof for a specified length of time prior to each incremental advancement thereof.

5. The system of claim 1, wherein said zone heating means includes an induction heating coil through which the bar passes for heating thereof, and means for energizing said induction heating coil.

6. The system of claim 5, wherein said induction heating coil is continuously energized both while the bar is stationary and during such incremental advancement thereof.

7. The system of claim 5, further comprising means for energizing said induction heating coil for a timed interval prior to each incremental advancement of the bar.

8. The system of claim 1, further comprising means for adjusting the location of said heating means to correspond to any such number of piece lengths in front of such shear plane.

9. The system of claim 8, wherein said heating means is mounted on a carriage for movement toward and away from such shear plane.

10. The system of claim 8, wherein said feed means includes means for advancing a second bar along with the first-mentioned bar in end-to-end butted engagement, and further comprising means for moving said heating means, after heating the last zone of the first-mentioned bar adjacent a remnant piece thereof, to a location corresponding to such number of piece lengths plus the remnant length in front of such shear plane, whereby the second bar when incrementally advanced one piece length is heated at a first zone spaced one piece length from its leading end.

11. The system of claim 10, wherein said heating means is mounted on a carriage for effecting such movements thereof.

12. The system of claim 10, wherein two adjusting means are provided, one for adjusting the location of said heating means to correspond to a multiple of piece lengths in front of such shear plane, and the other for moving the heating means, after heating the last zone of the first-mentioned bar adjacent a remnant piece thereof, to a location corresponding to such number of piece lengths plus the remnant length in front of such shear plane.

13. The system of claim 10, further comprising means for returning said heating means to its normal position when the remnant piece of the first-mentioned bar is ejected from the shearing means so that the second bar is always heated at such one piece length intervals as aforesaid.

14. The system of claim 1, further comprising stop means for initially locating the leading end of the bar relative to said heating means.

15. The system of claim 1, wherein said feed means includes means for advancing a second bar along with the first-mentioned bar in end-to-end butted engagement, and further comprising means for detecting the trailing end of the first-mentioned bar, means for determining the remaining length of the first-mentioned bar to be heated at such localized areas plus the remnant length of the first-mentioned bar after the trailing end of the first-mentioned bar has been detected, and means for moving said heating means, after heating the last zone of the first-mentioned bar adjacent a remnant piece thereof to a location corresponding to such number of piece lengths plus the remnant length in front of such shear plane, whereby the second bar when incrementally advanced one piece length is heated at a first zone spaced one piece length from its leading end.

16. The system of claim 15, wherein said means for detecting the trailing end of the first-mentioned bar comprises a bar end detector.

17. The system of claim 15, wherein said means for determining the length of the first-mentioned bar includes a measuring roller in rolling engagement with the first-mentioned bar, and means for measuring the number of revolutions of said roller.

18. The system of claim 17, wherein said means for measuring the number of revolutions of said roller includes a signal device connected to said roller, and a signal storage device controlled by said signal device.

19. The system of claim 1, further comprising distance measuring means for measuring the distance traveled by the bar.

20. The system of claim 1, further comprising gaging means for engaging and positioning the leading end of the bar one piece length beyond such shear plane during each incremental advancement thereof.

21. The system of claim 1, wherein said shearing means includes a fixed knife, a movable knife, and balanced clamping means cooperating with said fixed knife and movable knife for clamping the bar on both sides of the shear plane thereby to minimize distortion and bending of the bar during shearing.

22. The system of claim 21, further comprising means for adjusting the location of said heating means to correspond to different multiples of piece lengths in front of such shear plane.

23. The system of claim 21, wherein said balanced clamping means includes hold-down means for holding one side of the bar against said fixed knife, back support means for holding the other side of the bar against said movable knife, and hydraulic means for activating said hold-down means and back support means respectively to apply hold-down and back support forces proportional to the shearing force applied by said movable knife during shearing.

24. A zone heating and shearing system for shearing pieces of predetermined length from a bar, comprising shearing means for sequentially shearing the pieces from the end of the bar along a shear plane, zone heating means for heating the bar at a localized shear area thereof, said zone heating means including an induction heating coil through which the bar passes for heating thereof, means for energizing said induction heating coil, feed means for incrementally longitudinally advancing the bar one piece length at specified intervals past said zone heating means to said shearing means, and means for adjusting the location of said induction heating coil to correspond to the number of piece lengths in front of such shear plane necessary to permit the heat which is applied to the bar at longitudinally spaced areas by said induction heating coil to soak into such longitudinally spaced areas to increase the core temperature at such longitudinally spaced areas to a predetermined specified level by the time such longitudinally spaced areas are incrementally advanced from said zone heating means through a region free from heating to said shearing means and sheared thereby.

25. The system of claim 24, further comprising means for detecting the trailing end of the bar, and means for determining the remaining length of the bar to be heated at such localized areas plus the remnant length of the bar after the trailing end of the bar has been detected.

26. A zone heating and shearing system for shearing pieces of predetermined length from a bar, comprising shearing means for shearing the pieces from the end of the bar along a shear plane, said shearing means including a fixed knife, a movable knife, and balanced clamping means cooperating with said fixed knife and movable knife for clamping the bar on both sides of the shear plane thereby to minimize distortion and bending of the bar during shearing, zone heating means for heating the bar at a localized shear area thereof, feed means for incrementally longitudinally advancing the bar one piece length at specified intervals past said zone heaing means to said shearing means, means for locating said zone heating means at a plurality of piece lengths in front of such shear plane, whereby longitudinally spaced zones of the bar are sequentially heated at said localized shear areas located one piece length intervals apart and the heated zones are given time to soak in a region free from heating as the bar is incrementally advanced from the zone heating means before shearing takes place at each such heated zone, and gaging means for engaging and positioning the leading end of the bar one piece length beyond such shear plane during each incremental advancement thereof.

27. A method of shearing pieces of predetermined length from bar stock, comprising the steps of incrementally longitudinally advancing a bar one piece length at specified intervals past a zone heating element toward a bar shear to heat the bar at incrementally spaced localized shear areas thereof, locating such zone heating element at a number of piece lengths in front of such bar shear corresponding to the soak time required to obtain the desired core temperature at each localized shear area by the time each localized shear area is incrementally longitudinally advanced from the heating zone through a region free from heating to the bar shear, and sequencially shearing the bar after each incremental advance of the bar at the then presented localized shear area.

28. The method of claim 27, wherein the bar shear includes a fixed knife, a movable knife, and balanced clamping means cooperating with the fixed knife and movable knife for clamping the bar on both sides of the shear plane thereby to minimize distortion and bending of the bar during shearing.

29. The method of claim 28, wherein one side of the bar is held against the fixed knife, and the other side of the bar is held against the movable knife during shearing.

30. The method of claim 29, wherein hold-down and back support forces proportional to the shearing force are respectively applied to the bar during shearing.

31. The method of claim 27, wherein the step of advancing includes advancing a second bar with the first-mentioned bar in end-to-end butted relationship.

32. The method of claim 31, further comprising the steps of detecting the trailing end of the first-mentioned bar, determining the length of the remnant piece of the first-mentioned bar, and moving the heating element to a location such number of piece lengths plus the remnant length in front of the bar shear after the last zone of the first bar is heated and before the first zone of the second bar is heated.

33. The method of claim 32, further comprising the step of returning the heating element to its normal location after or while the remnant piece of the first bar is discharged from the bar shear and the leading end of the second bar has been advanced one piece length beyond the shear plane of the bar shear.

34. The method of claim 27, further comprising the step of adjusting the energy output of the zone heating element to cause the zones of the bar to be exteriorly heated to the desired temperature within the length of time it takes to shear the bar.

35. The method of claim 27, further comprising the step of timing the power output of the zone heating element to correspond to or be less than the time that it takes to shear the bar.

* * * * *